US005830037A

United States Patent [19]

Mastandrea, Jr.

[11] Patent Number: 5,830,037

[45] Date of Patent: Nov. 3, 1998

[54] NOISE-MAKING STRIP

[75] Inventor: Joseph D. Mastandrea, Jr., Verona, Pa.

[73] Assignee: Mercury Printing, Pittsburgh, Pa.

[21] Appl. No.: 711,160

[22] Filed: Sep. 9, 1996

[51] Int. Cl.[6] ..... A63H 5/00

[52] U.S. Cl. ..... 446/415; 446/397; 472/56; 40/124.09

[58] Field of Search ..... 446/415, 418, 446/397, 488; 472/51, 56; 40/299, 124.09, 124.14

[56] References Cited

U.S. PATENT DOCUMENTS

| | | | |
|---|---|---|---|
| 695,159 | 3/1902 | Lambert | 446/415 |
| 1,206,933 | 12/1916 | Simonds et al. | 446/415 |
| 1,509,956 | 9/1924 | Kipp | 446/418 |
| 2,488,509 | 11/1949 | Lewin | 116/2 |
| 2,725,651 | 12/1955 | Spear | 40/124.13 |
| 3,092,927 | 6/1963 | Luchsinger | 446/397 |
| 3,990,177 | 11/1976 | Daraux | 472/56 |
| 5,045,017 | 9/1991 | Masson | 446/415 |
| 5,106,332 | 4/1992 | Segan et al. | 446/415 |

FOREIGN PATENT DOCUMENTS

| | | | |
|---|---|---|---|
| 22251 | 2/1948 | Finland | 446/415 |
| 76855 | 5/1950 | Norway | 446/415 |

*Primary Examiner*—Laura Fossum

[57] ABSTRACT

An improved noise-making device (100) comprises a symmetrical, flexible strip of laminated paper upon which four creases (20, 22, 24, and 26) and two slits (30 and 32) have been applied. Subsequent user preparation by curling and folding converts the two-dimensional strip into two straps (40 and 42), concave in relation to one another, joined at each end by wings (10, 12, 14, 16) such that pulling the wings apart brings the straps in full contact, generating a loud snapping sound while simultaneously imparting a kinesthetic impulse to the hands. When the wings are brought toward each other, the curl applied in preparation allows the straps to return to their concave state. Messages or advertising may be imprinted upon the surface to promote any suitable event where the device is used.

6 Claims, 3 Drawing Sheets

NOISE-MAKING STRIP

BACKGROUND-FIELD OF INVENTION

This invention relates to noise-making devices for amusement purposes. Specifically, the invention relates to such noise-making devices used in a celebratory manner at events where a theme exists.

BACKGROUND-DESCRIPTION OF PRIOR ART

People have an inherent need to express happiness when feelings of joy overcome them. Holidays, parties, and sporting events are all good examples of times when these expressions surface.

Generally, means for these expressions consist of cheering and clapping when no devices are available to add to the festivities. Although this is appropriate, often it is inadequate. This is especially true in open spaces such as arenas and stadiums. To this end, noisemakers have been effectively used to enhance celebration.

The noisemaker has a varied and long history: from drums, whistles, and shakers to today's synchronized fireworks display. But the common denominator is to involve the participants in unified spirit and camaraderie. Insofar as noisemakers go, there is little to suggest that any provide the combination of portability, loudness, economy, durability, simplicity, and promotional appeal that would define a landmark invention in this field.

While drums are loud and durable, they are too cumbersome and expensive for large groups of people. There is a level of expertise required to co-ordinate and synchronize a large group of users which is impractical with crowds.

Whistles, while fulfilling all the desirable characteristics save perhaps promotability, would interfere with the referee's whistle found in most sporting events. This would create confusion among the players to the detriment of the game.

Shakers could conceivably be designed to be small and inexpensive. However, their loudness, even in large groups, would likely be limited to a droning hiss.

The following patents have been found during the search process that specifically relate to noisemakers that could be used in a group environment:

U.S. Pat. No. 695,159 (1902) to Lambert for his sound reproducing apparatus seems inadequate as a significant noisemaker since technology has gone leaps and bounds beyond his mechanical device. It appears not to be particularly durable and would have to be quite large to generate a substantial noise.

Simonds & Doerr have, in their patent U.S. Pat. No. 1,206,933 (1916) for a metal clicker, used most of the salient aforementioned features. Their patent archaically describes its sound being similar to a cannon or a wild animal. Unfortunately, the clicking sound in groups approaches that of a field of summer crickets. This may be interesting for a short time, but hardly supports "esprit-de-corps" in a group situation.

Lewin's foreign patents for "Fugelskremsel" [Norway 76855 (1948)] and "Fagelskramma" [Finland 22251 (1948)] are not practical from a portability or promotability standpoint. The device has many holes, leaving little space to put promotional copy. Since they are made from metal foil, one would think that the safety factor (if rigid) or durability (if soft) would be compromised. It appears to generate a whooping, thunderlike sound.

Similarly, Segan and Cohen created a handled "whooping" plate, granted U.S. Pat. No. 5,106,332 (1990), that seems to make a similar noise but with plastic rather than metal. The preferred embodiment however seems to be a bit bulky for smaller hands and would take up significant shelf space even if assembled by the end user. This assembly, while apparent to those skilled in the art, may befuddle the novice. If any of the parts are lost or broken, the user must purchase a new, complete set.

Another noisemaker with handle and streamers by Rudy Masson, U.S. Pat. No. 5,045,017 (1990), utilizes similar physics and poses similar disadvantages as the "whooping" plate. Moreover, the indistinct, nonpercussive noise of this device does not create the unified spirit that allows the crowd to synchronize with music or cheers. The economy of producing large quantities of devices, from materials like plastic with silk-screening, seem to prohibit a person from passing these out as party favors or for an organization to have an inexpensive promotional give-away.

It is accordingly the object of this invention to provide an improved noisemaker that is inexpensive, durable, and easy to use, and gives larger groups of users the satisfaction of being synchronized in their efforts.

It is also an object to provide an improved noisemaker that will allow compact storage of large quantities of said device for vending purposes. In situations where organizations need a high-volume promotional item, this is a key consideration.

It is a paramount object to provide an improved noisemaker that comprises one-piece construction. This allows simplified manufacturing and easy preparation for end use.

SUMMARY OF THE INVENTION

In broad terms, the invention is noisemaker comprising a single symmetrical, flexible strip, slitted and scored in such a way as to provide two straps joined with two sets of gripping wings. After curling and folding the strip in initial preparation, the invention becomes three dimensional. As the wings are pulled apart rapidly, the inner surfaces of the straps make full contact with each other. The resulting impact creates a very loud and distinct snapping noise. When the wings are brought together, the straps bow away from each other due to the applied curl that the preparation endows to the invention, making it ready for the next snap.

The strip's preferred embodiment is comprised of film-laminated paper, providing a very inexpensive cost when produced in multiples on a single large sheet. The material has additional advantages of cost-effective imprinting of a sponsor's logos and messages, low weight to minimize user fatigue, and water/moisture resistance. It is possible that other durable, imprintable materials such as polystyrene or acetate could be used effectively.

The invention also comprises a method for preparation of the one-piece strip from its flat state for distribution to its three-dimensional state for making noise. This provides an added value to vendors since many strips can be stored in a very small space.

The invention also comprises a noisemaking device that has a well-defined sound that can be easily synchronized with cheers or music. This effect is critical to establishing "esprit-de-corps" among groups of users and adds to the communal spirit that these celebrants desire.

Further objects and advantages will be apparent from the following descriptions and drawings of the preferred embodiments of the aforementioned invention.

REFERENCE NUMERALS IN DRAWINGS

Figure 1A:
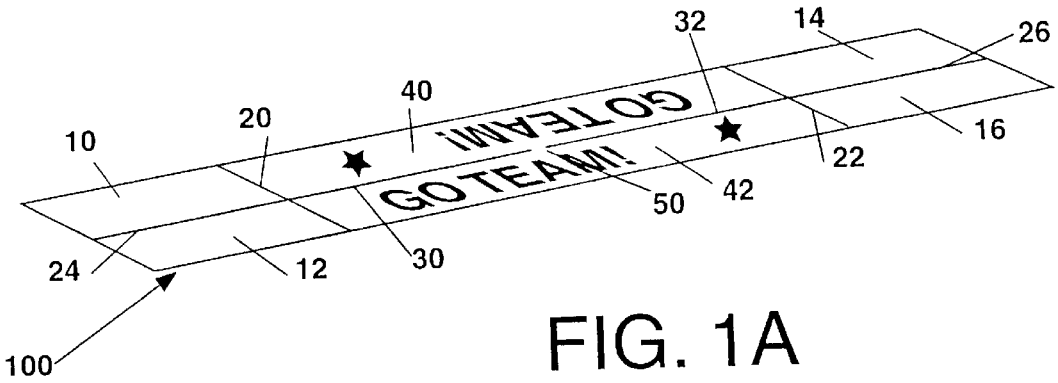
FIG. 1A is a perspective view of the noisemaker in its flat state.

10 upper left wing
12 lower left wing
14 upper right wing
16 lower right wing
20 left strap crease
22 right strap crease
24 left wing crease
26 right wing crease
30 left slit
32 right slit
40 upper strap
42 lower strap
50 strap nib
100 strip

DESCRIPTION

Figure 1B:
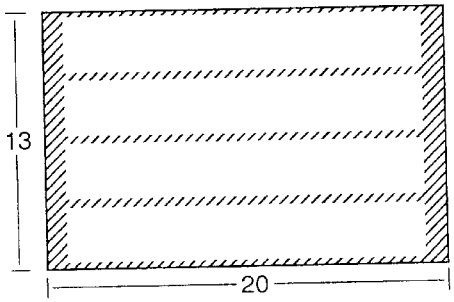
FIG. 1B is a plan view for four strips to a sheet.
Figure 1C:
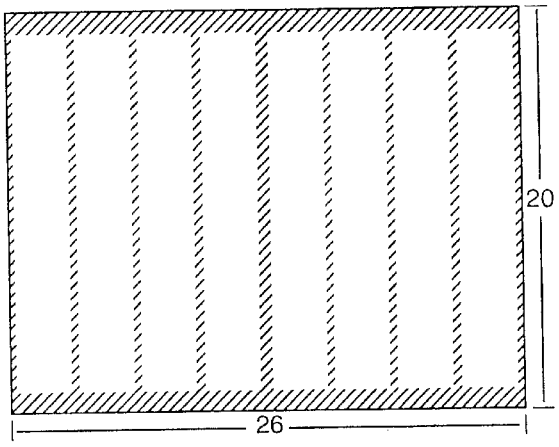
FIG. 1C is a plan view for eight strips to a sheet.

FIGS. 1A, 1B, and 1C

The preferred embodiment of the noise-making strip (100) is illustrated in FIG. 1A. It comprises a flexible sheet of durable, imprintable material that can be bent without fracturing. A vital feature of the strip is that it is symmetric with respect to both the central lengthwise axis and the central widthwise axis so that corresponding parts coincide after user preparation.

Effective prototypes utilize 12 point, coated-one-side, cover-weight paper (herein termed "12pt C1S") that have 1.5 mil film lamination applied to both sides after printing. These materials are readily available in most metropolitan marketplaces through a variety of paper merchants and graphic supply houses.

After printing and lamination, the material is machined to apply four creases (20, 22, 24, and 26) and two slits (30 and 32) as shown in FIG 1A. Strap creases (20 and 22) are perpendicular to the lengthwise axis of symmetry and traverse the full width of the strip. Wing creases (24 and 26) are coincidental with the lengthwise axis and run from either short edge to its respective strap crease, dividing each area subtended equally into an upper wing (10 and 14) and lower wing (12 and 16). Two slits (30 and 32) are applied from the point of intersection of either wing crease with its respective strap crease, coincidental with the lengthwise axis, to a point just short of the center of the strip. This creates the upper strap (40) and lower strap (42) which are joined in the center of the strip by a strap nib (50), which is a direct result of the slits not meeting at the center. The strap nib serves the important function of keeping the strips flat and from catching on each other when stacked and transported. After machining, multiple-strip sheets are trimmed to final size strips.

Since the preferred embodiment has nominal, and by no definition final, rectangular dimensions of 18" in length by 3" in width by 0.015" in thickness, it is practical to produce four strips on a sheet of 13"×20" material (FIG. 1B) or eight strips on a sheet of 20"×26" material (FIG. 1C). This minimizes wasted material, shown as shaded areas in FIGS. 1B and 1C, and uses popular and available sizes of 12pt C1S, as well as offset printing machine capabilities. The wing creases are each 3.5" long and the slits are each 5.49" long and the strap nib is 0.02" of material between the left and right slits.

USER PREPARATION

FIGS. 2, 3, 4, and 5

Figure 2:
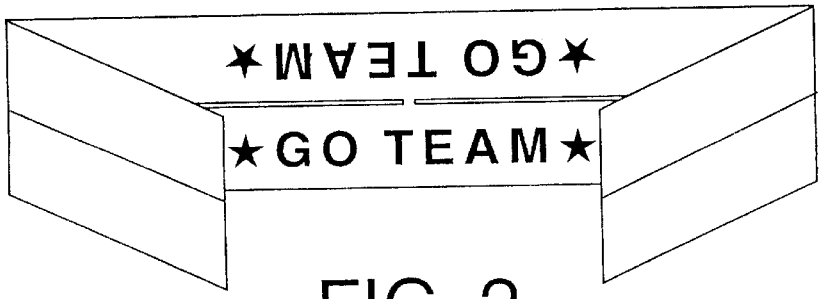
FIG. 2 is a perspective view after the first step of user preparation of the noisemaker.
Figure 3:
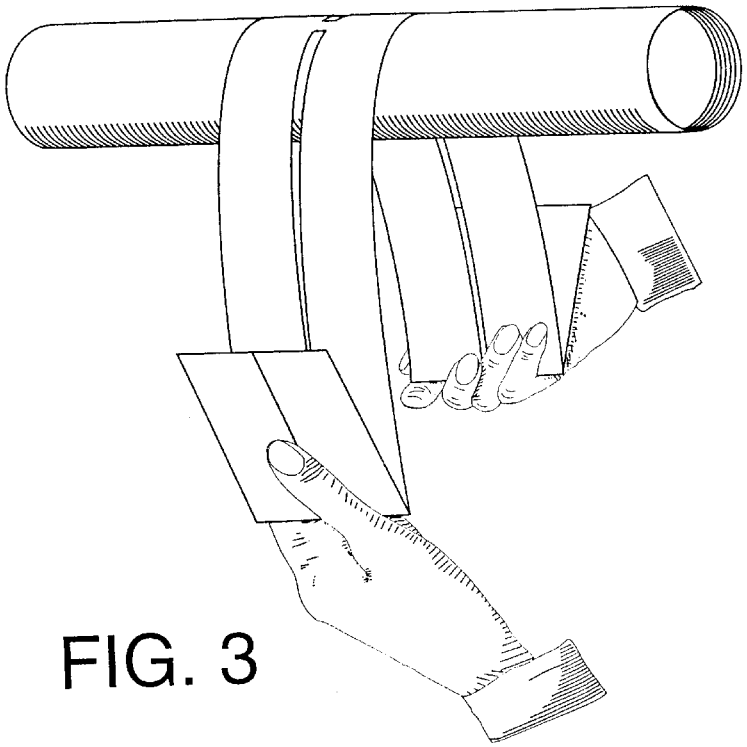
FIG. 3 is a perspective view during the second step of user preparation of the noisemaker.
Figure 4:
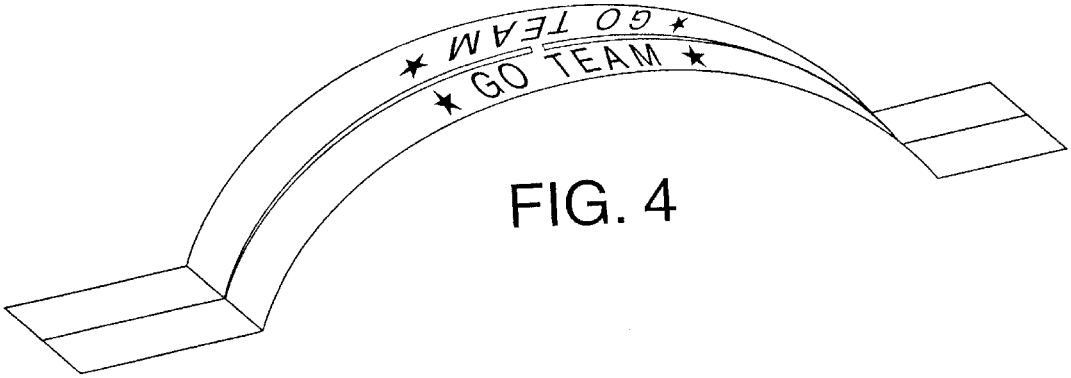
FIG. 4 is a perspective view after the second step of user preparation of the noisemaker.
Figure 5:
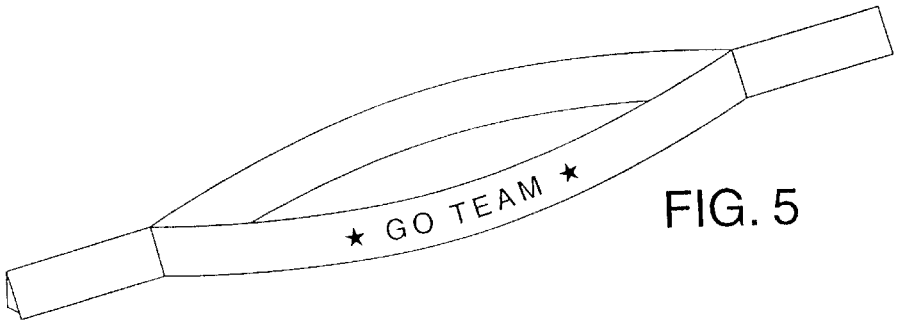
FIG. 5 is a perspective view after the final step of user preparation of the noisemaker.

After distribution, the user prepares the strip (100) in the following manner. The user first folds the strip along the left (20) and right (22) strap creases so that the upper wings (10 and 14) touch the imprinted side of the upper strap (40) and the lower wings (12 and 16) touch the imprinted side of the lower strap (42), as depicted in FIG. 2. Then grasping the strap creases (20 and 22) between the thumb and forefinger of corresponding hands, the straps (40 and 42) are curled by pulling them around a solid surface, such as the edge of a countertop or the top of a chairback, while maintaining tension on the straps. This is shown in FIG. 3. The excellent nature of the laminated paper allows this curl to hold its shape for an indefinite period of time when released, as illustrated in FIG. 4. The user then breaks the straps (40 and 42) apart by tearing the strap nib (50) and folds along the wing creases (24 and 26) each upper wing (10 and 14) onto its respective lower wing (12 and 16) so that the straps (40 and 42) are concave with respect to each other, with printing on the outside of the bowed straps as in FIG. 5. The fully prepared invention is now operational.

OPERATION

Figure 6:
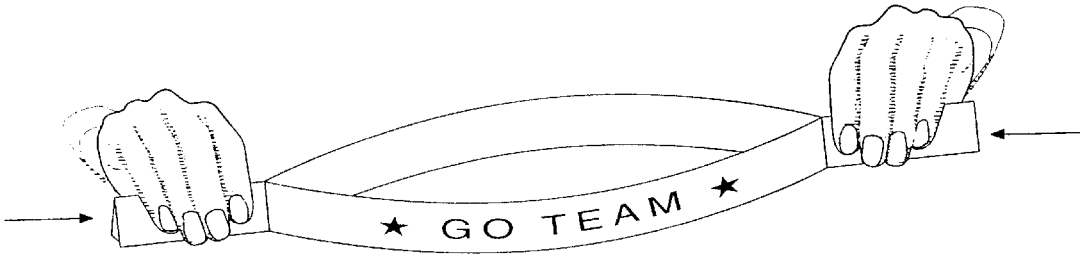
FIG. 6 is a perspective view of the noisemaker in the passive phase of user operation.
Figure 7:
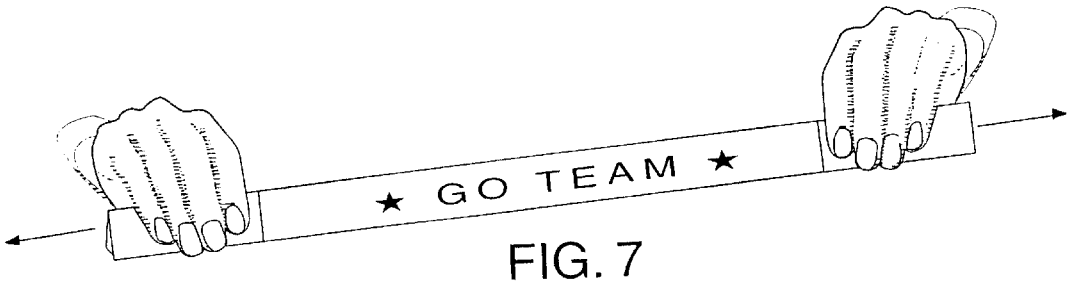
FIG 7 is a perspective view of the noisemaker in the active phase of user operation.

FIGS. 6 and 7

To operate the invention, the user places the fingertips of each hand onto the corresponding upper wings (10 and 14) and squeezes them into the respective lower wings (12 and 16) that are resting against the palms of the hands. This natural grip is shown in FIG. 6. By moving the hands apart in a quick motion, tension is applied to the bowed straps (40 and 42) which are identical lengths due to the invention's topology. At the point where straps are straightened, there is impact along the full interior of the straps along with the sudden expulsion of the air between them, causing a very loud whiplike snap. This position is shown in FIG. 7.

At this precise point, the hands suddenly stop, giving the user a simultaneous physical sensation with the noise. It is this accurate synchronization of sound and kinesthetic impulse that allows users to keep a very good rhythm with cheers and music. As the hands are brought together again, the invention reverts to its passive state (FIG. 6) because of the curl applied in the initial preparation.

SUMMARY, RAMIFICATIONS, AND SCOPE

Accordingly, the reader will see that the aforementioned invention fulfills all of the attributes of an excellent noise-maker:

Portability: Based on the aforementioned dimensions, over 3000 can be stored (in their flat state) in a typical carton measuring 12×12×18. The invention can be folded to fit in user's pocket or rolled & rubberbanded to sit in a desk drawer when not in use. It is also very lightweight.

Loudness: The invention has been reported by uninterested parties as being much louder than clapping and much like the sound of a whip. It can be heard at distances of better than 100 yards.

Economy: Market values vary from printer to printer, but estimates show production costs in the 1996 Pittsburgh market for a small quantity of 1000 to be less than $1 per unit for custom imprinting on film-laminated paper. Larger lots can be produced in full color for less than $.25 each.

Durability: Prototypes constructed of film-laminated paper have tested in the range of 5000 to 8000 snaps over a two month period (significantly more use than any promotable event would need) before the strap creases have weakened and cracked. The film lamination provides good water-resistance in outdoor environments. Other mentioned embodiments could drastically improve the life cycle of the invention.

Simplicity: Tested with young children, the strip was easy to use. Five-year-olds could prepare the strip after watching an adult do so; two-year-olds made the noise by imitating others. One-piece construction means no lost parts. With very little practice, users find themselves creating rapid repetitions and rhythms that rival bonafide percussion instruments.

Promotional Appeal: Sports organizations benefit from the slogans, mottos, and logos of the team and its sponsors imprinted on the strip. The support of sports fans audibly and visibly manifests itself by distribution and use. Generic holiday versions ("Snappy New Year", "Snappy Birthday", "Snappy Fourth of July", etc.) make fine party favors and add to small gatherings where noisemakers are appropriate. Any large public relations concerns, such as television and radio stations, major colleges and universities, or political campaigns benefit from distributing their messages with this unique invention.

Although the above descriptions contain many specifications, these should not be construed as limiting the scope of the invention but as merely providing illustrations of some of the presently preferred embodiments of this invention. For example, holes may be applied to the straps to create subtle differences in sound timbre, or varying dimensions may increase production economy, or varying the perimeter shape may make a more attractive or appropriate design, or using different materials may result in any of the above improvements.

Thus the scope of the invention should be determined by the appended claims and their legal equivalents, rather than through given examples.

I claim:

1. A noise-making device comprising a symmetrical, flexible strip of material, wherein a lengthwise axis of symmetry orthogonally intersects a widthwise axis of symmetry at a nib of said material, at the center of said material, from which a slit radiates in each of two opposite directions, each coincidental with said lengthwise axis and each terminating at a strap crease, each said strap crease parallel to and equidistant from said widthwise axis, and extending from either juncture of each of said slits and each of said strap creases to either edge of said strip, coincidental with said lengthwise axis, a wing crease.

2. A. The noise-making device of claim 1, wherein said material between said strap creases comprises a pair of straps and said nib, and said material outside said strap creases comprises a pair of wings and said wing crease on either side.

3. The noise-making device of claim 2, wherein said material is comprised of a substrate of paper and a surface of plastic film laminated to said substrate.

4. The noise-making device of claim 2, wherein said surface and/or said substrate have indicia imprinted thereon.

5. A method of preparing the noise-making device of claim 2 comprising:

a) providing the noise-making device as claimed in claim 2;

b) folding along said strap creases so said wings touch said straps;

c) curling said straps around some solid surface;

d) separating said straps by tearing said nib;

e) folding said wing creases such that said straps are in a state of mutual concavity.

6. A method of operating the noise-making device as prepared in claim 5 comprising:

a) providing the noise-making device as prepared in claim 5;

b) gripping said wings, with one adjacent pair of said wings held in each hand;

c) rapidly separating said hands thereby applying a tension to said straps, causing said surfaces to make full contact and expel the air between them, generating a discrete noise while imparting a simultaneous kinesthetic impulse to said hands; and d) relaxing said hands by approaching one hand to the other wherein the applied curl to said straps causes their return to said mutually concave state.

* * * * *